United States Patent [19]

Bradley

[11] 4,273,166

[45] Jun. 16, 1981

[54] COMBINATION FUNNEL AND SIPHON

[76] Inventor: Alan V. Bradley, 616 Lincoln Ave., Crookston, Minn. 56716

[21] Appl. No.: 81,800

[22] Filed: Oct. 4, 1979

[51] Int. Cl.[3] ..... B65B 39/04; B67C 11/00

[52] U.S. Cl. ..... 141/95; 141/297; 141/340

[58] Field of Search ..... 141/1, 98, 94-96, 141/199-205, 230, 286, 297-300, 323, 331-345

[56] References Cited

U.S. PATENT DOCUMENTS

| | | | |
|---|---|---|---|
| 130,302 | 8/1872 | Lawrence | 141/300 X |
| 1,705,312 | 3/1929 | Rovano | 141/297 |
| 1,810,822 | 6/1931 | Erickson | 141/297 X |
| 2,811,181 | 10/1957 | Correll | 141/340 |

FOREIGN PATENT DOCUMENTS

| | | | |
|---|---|---|---|
| 11405 | 4/1903 | Austria | 141/300 |
| 564228 | 10/1923 | France | 141/300 |

*Primary Examiner*—Frederick R. Schmidt
*Attorney, Agent, or Firm*—H. Dale Palmatier

[57] ABSTRACT

A funnel-shaped receptacle with a neck portion adapted for sealing attachment to the neck portion of a gas tank, the neck portion having disposed therein a rigid tube running vertically from the mouth of the neck and then horizontally to an outer side of the receptacle. A flexible tube is connected to the outside portion of the rigid tube and runs to the upper portion of the receptacle, where it is detachably secured to a lip member integrally formed on the receptacle. A metal screen is disposed within the receptacle across the neck portion thereof. When fuel overflows into the receptacle during the pouring operation, pouring is discontinued and the flexible tube is detached from the receptacle and inserted into the pouring container, after it has been placed on the ground, to thereby cause siphoning of the overflow fuel back into the pouring container, to completely eliminate waste or spillage of fuel.

4 Claims, 5 Drawing Figures

FIG. 1
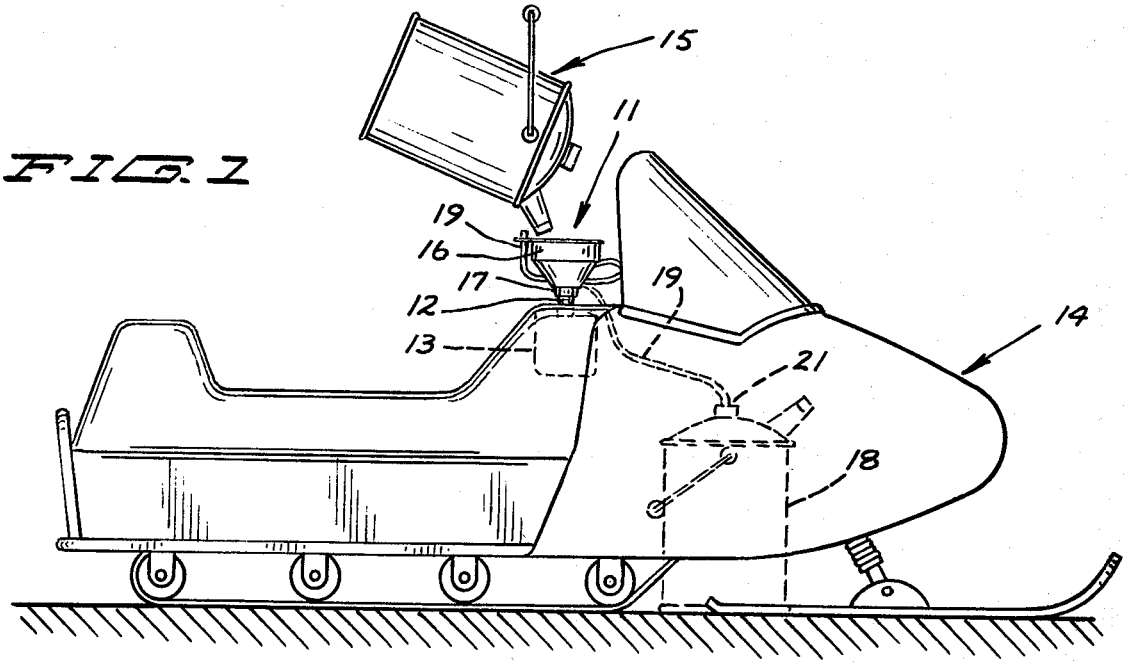
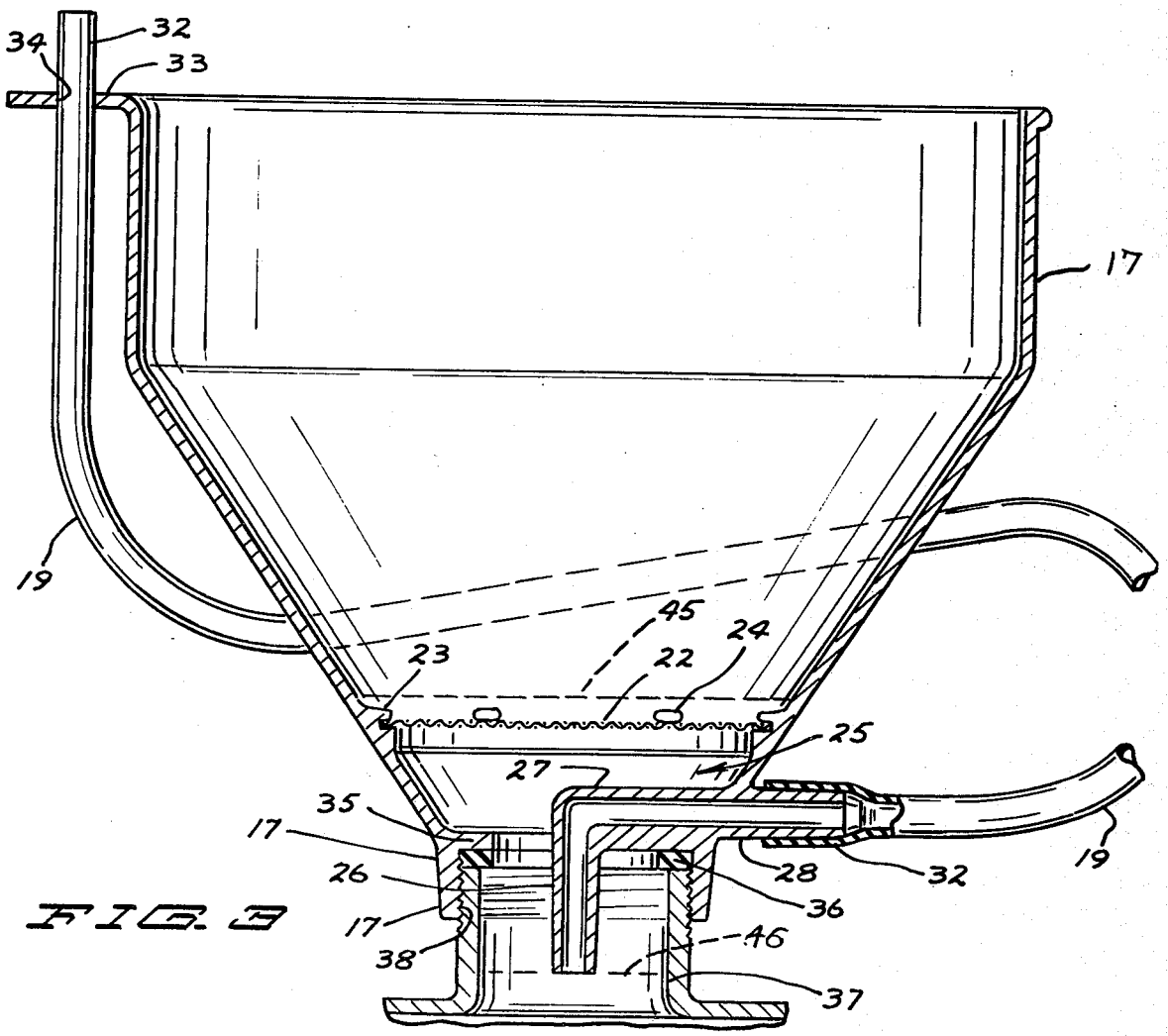
FIG. 3

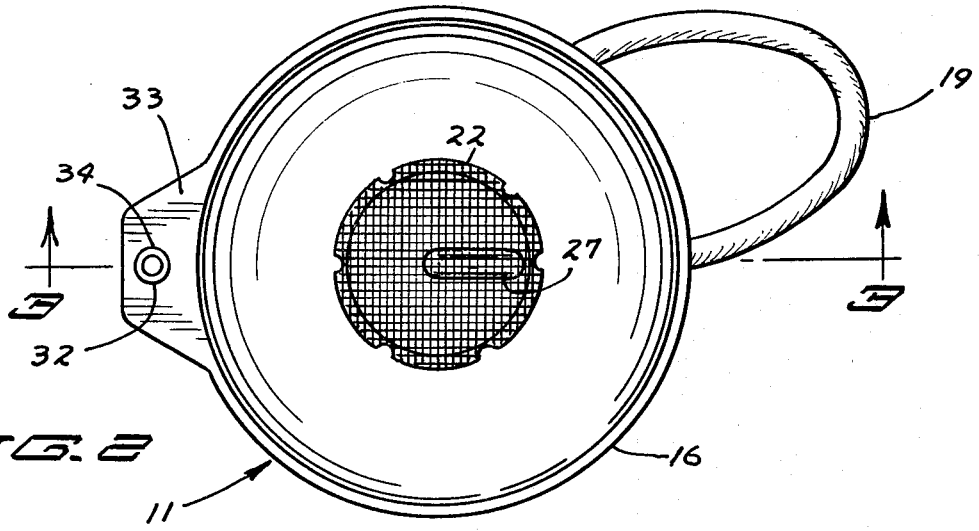
FIG. 2
FIG. 4
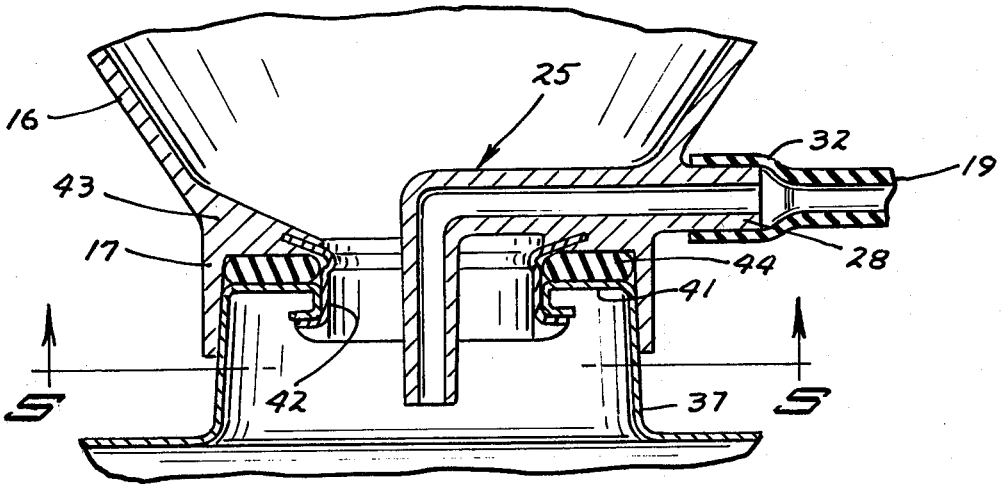
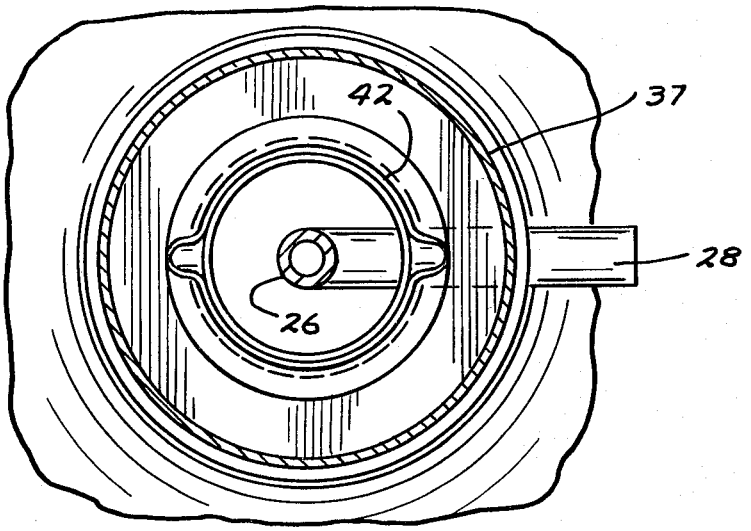
FIG. 5

COMBINATION FUNNEL AND SIPHON

BACKGROUND OF INVENTION

This invention relates to funnels, and, more particularly, to a combination funnel and siphon.

Funnels have long been used for transferring fluids from one container to another, and have proven to be especially useful in pouring gasoline and other fuels from a hand-holdable vessel into a fuel tank. The most common usages include those of pouring gasoline from a gas can into the gas tank of a car, lawnmower, snowmobile, etc. The difficulty here is that there is no way of telling when the tank is filled, with the result that gasoline overflows into the funnel and is wasted. Obviously, such overflow can also result in splashing of fuel onto the funnel's user.

Devices to prevent overflow and splashing of fuel have primarily been constructed of a funnel shape, with modifications being made as to the width of funnel mouth, the length and angle of funnel neck, and so forth. A few earlier attempts were made to combine a funnel and siphon, as disclosed principally by Erickson, U.S. Pat. No. 1,810,822 and Rovano, U.S. Pat. No. 1,705,312, but such devices have not proven to be practical. That is, they have failed to provide funnels which can be easily and quickly secured in full sealing relationship to the neck of gas tanks, and which at the same time have accessible tubing for siphoning off of gas after overflow into the funnel portion. Other earlier patents illustrating the state of the art in funnel design are Hilford, U.S. Pat. No. 1,676,986, and Eves, U.S. Pat. No. 1,820,610.

SUMMARY OF INVENTION

In accordance with this invention there is provided a combination funnel and siphon comprising a hand-holdable receptacle having a fuel-receiving opening at its upper end and a substantially narrower fuel-exiting opening at its lower end, the lower end being adapted for sealing attachment to the neck of a gas tank. A screen is disposed within the receptacle across the lower end thereof. A tube is disposed within the receptacle, running upwardly from the opening of the lower end thereof to a point below the level of the screen, then to an outer side of the receptacle and up along the side to the upper portion thereof. Holding means is disposed on the upper portion of the receptacle for holding the outer end of the tubing in easily accessible position. In use, the combination funnel and siphon is secured to the neck of a gas tank and fuel is poured through it into the tank, until fuel has backed up within the receptacle to a point above the level of the screen, after which the upper end of the tubing is detached from the holding means and inserted into the opening of the pouring container, which has been placed on the ground adjacent the filled tank. Overflow fuel in the receptacle will then begin to run through the tubing and into the pouring container, until the level of fuel in the tank has fallen below the upper portion of the neck thereof. The siphon will then stop and the funnel can be removed from the tank and the ordinary gas cap replaced.

The tubing within the neck portion of the receptacle is preferably of rigid construction integrally formed with the receptacle itself, and runs vertically from just below the bottom of the neck up to a point below the level of the screen and then horizontally to an outer side of the receptacle, where it has a slip-on extension for connection to flexible tubing running up to the upper portion of the receptacle. A metal screen is provided for cold weather usage, so as to collect moisture during the pouring process. The screen further serves as an indicator, along with the horizontal portion of the rigid inner tube, to indicate to the user that overflow of fuel has occurred. That is, pouring of the fuel can be discontinued upon the user observing the level of overflow reaching above the level of the screen.

Preferably, the neck of the receptacle is internally threaded or provided with lugs for sealing attachment to the neck portion of a gas tank mounted on the engine of a lawnmower, snowmobile, or other such device. To provide complete sealing, the neck portion of the receptacle has a sealing shoulder for abutting the upper surface of the gas tank neck, as well as a gasket disposed therebetween, such that the funnel can be sealed tightly to the neck of the gas tank and firmly held thereto during the pouring operation.

It is a primary object of this invention to provide a combination funnel and siphon which can be firmly and easily secured to the neck portion of a gas tank in completely sealed relationship thereto, to allow steady pouring and subsequent siphoning of overflow fuel with a minimum of attention by the user.

It is another object of this invention to provide a combination funnel and siphon wherein the structural components thereof serve as indicator means to indicate when overflow of fuel has occurred.

It is yet another object of this invention to provide a combination funnel and siphon wherein the siphoning tube is readily accessible to the user.

It is a further object of this invention to provide a combination funnel and siphon having a means for collecting moisture during pouring of fuel under sub-zero weather conditions.

BRIEF DESCRIPTION OF THE DRAWINGS

FIG. 1 is a side view of the combination funnel and siphon of this invention shown in place on the neck portion of a snowmobile gas tank;

FIG. 2 the top plan view of the combination funnel and siphon of this invention;

FIG. 3 is a sectional view taken along line 3—3 of FIG. 2;

FIG. 4 is a fragmentary sectional view similar to to that of FIG. 3 showing a modified construction of the neck portion of the receptacle; and FIG. 5 is a sectional view taken along line 5—5 of FIG. 4.

DESCRIPTION OF THE PREFERRED EMBODIMENTS

Referring to FIG. 1 of the drawings, the combination funnel and siphon 11 of this invention is shown in place on the neck portion 12 of a gas tank indicated by dotted lines 13. Gas tank 13 is shown within the body of snowmobile 14, and has its neck portion 12 extending vertically therefrom as indicated. Similar gas tanks can be found on lawnmowers and various other implements, all of which can be advantageously filled using the combination funnel and siphon of this invention.

After combination funnel and siphon 11 has been secured to neck portion 12, as will be described in more detail below, fuel may be poured from container 15 through receptacle 16 and neck portion 17 into gas tank 13. When an overflow of fuel into receptacle 16 occurs, the pouring operation is discontinued and pouring container 15 is placed alongside the implement being fueled. The after-pouring position of container 15 is indicated by dotted lines 18. Flexible tubing 19, which is detachably secured to the upper edge of receptacle 17, as will also be discussed in greater detail below, is then detached and the end inserted into the opening 21 of pouring container 15. All of the fuel which has backed up into the neck and receptacle will be siphoned off through tubing 19 into container 15, to thereby completely eliminate any waste of fuel or spilling on the user.

Referring to FIGS. 2,3, a metal screen 22 is disposed within receptacle 16 above neck portion 17 thereof. Metal screen 22, which can be formed of brass, aluminum, or steel, is either snapped within ledges 23 integrally formed into the side walls of receptacle 16, or heat sealed thereto. In addition to its screening function, metal screen 22 further serves as an indicating device to indicate to the user that fuel has overflowed into receptacle 16. Additionally, metal screen 22 collects moisture during the pouring operation and, in cold weather, causes water to form into ice particles 24 in the screen, thereby permanently removing water from the fuel and preventing stalling out of the implement being fueled.

Rigid tube 25 is disposed within the lower portion of combined funnel and siphon 11, with vertical portion 26 running from just below the bottom of neck portion 17, and horizontal portion 27 running to an outer side of receptacle 16, and terminating in slip on extension portion 28. Rigid tube 25, including slip-on extension portion 28, can be integrally formed with receptacle 16 of any conventional and durable plastic.

A flexible tube or hose 19 is pushed at end 32 onto the slip-on extension 28 of rigid tube 25, and extends to the upper portion of receptacle 16 where it is detachably secured at end 32 by lip portion 33, also integrally formed with receptacle 16. As shown in FIG. 2, lip member 33 is provided with an aperture 34 into which upper end 32 of flexible tube 19 can be inserted and firmly held in readily accessible position during storage, transport, or use of the combination funnel and siphon during a pouring operation. It is also noted, as shown in FIG. 2, that horizontal portion 27 of rigid tube 25 also provides an indicating function during the pouring operation. That is, the user will be looking down into receptacle 16 during the pouring operation, and will first observe the covering of horizontal portion 27 of rigid tube 25, as overflow occurs. Pouring can be discontinued at such point, and siphoning begun. However, if this first indication of overflow has not been observed, the user will be provided with a second indicator, namely, metal screen 22. Upon overflow above the level of metal screen 22, the overflow condition will again be readily observed, and pouring can be discontinued, and siphoning begun. Accordingly, both metal screen 22 and horizontal section 27 of rigid tube 25 provide easily usable indicator means for making even the most inattentive user aware that an overflow condition has been reached.

Neck portion 17 of combined funnel and siphon 11 is provided with an integrally formed sealing shoulder 35 and a fiber or plastic gasket 36 for abutting the upper surface of gas tank neck 37. Neck portion 17 has internal threads 38 such that combination funnel and siphon 11 can be screwed onto gas tank neck 37, thereby bringing sealing shoulder 35 and gasket 36 into an overall complete sealing relationship between neck portion 17 and gas tank neck portion 37. Combination funnel and siphon 11 will then be firmly secured to gas tank neck portion 37, and there will be no need to hold it with one hand during the pouring operation, as is required with other funnel devices. That is, once in place, combination funnel and siphon 11 need not be otherwise supported and the user is free to pick up the pouring container with both hands and commence the pouring operation.

Referring to FIGS. 4,5, neck portion 17 of combined funnel and siphon 11 has been modified for attachment to a gas tank neck portion 37 having lugs 41 instead of threads, as in FIG. 3. Mating lugs 42 are set into portions 43 of neck portion 17 such that the combined funnel and siphon 11 can be firmly secured to gas tank neck portion 37 in the same manner that a conventional gas cap is secured thereto. Gasket 44 completes the seal between neck portion 17 and gas tank neck portion 37.

In operation, combined funnel and siphon 11 is attached to the neck portion of a gas tank, as illustrated in FIG. 3. A pouring container can then be used in a conventional fashion to pour gasoline into the interior of receptacle 16 such that it flows downwardly through gas screen 22, through neck 17, and into the gas tank of the implement being fueled. When the gas tank has been filled, an excess of fuel may overflow into receptacle 16 until it reaches a level indicated by dotted line 45, at which point the overflow will be clearly visible above screen 22. Pouring is then discontinued and the overflow fuel can be returned to the pouring container simply by setting the pouring container on the ground and directing flexible tube 19 into the opening thereof, whereupon the excess fuel in the receptacle 16 and in neck portion 17 and gas tank neck portion 37 will be siphoned by rigid tube 25 and flexible tubing 19 into the pouring container. It is noted that by filling the tank until an overflow condition is reached, that is, until the level indicated by dotted line 45 is reached, rigid tube 25 is primed so that when the upper end of flexible tube 19 is swung down into the pouring container on the ground, fuel will begin to run. The siphon will continue to work until the level of fuel in the tank goes down to the level indicated by dotted lines 46, at which time the siphon will stop and the funnel can be removed from the gas tank and the gas cap replaced.

It is seen that the combined funnel and siphon of this invention provides an inexpensive and readily used device for the funneling of gasoline into the gas tanks of a variety of implements, and the siphoning of excess or overflow fuel from the funnel portion back into the pouring container after the gas tank has been filled. The combination funnel and siphon can be used with little or no instructions to fill a gas tank under all types of weather conditions, without any waste of gasoline, and also without any danger of spillage of gasoline.

What is claimed is:

1. A funnel for directing liquid into the cap-anchoring filler neck of a tank, comprising a funnel-shaped receptacle having an open top and a peripheral wall and a lower annular sleeve formed integrally of the receptacle to embrace and seal against the filler neck of the tank and direct liquid into the tank, the sleeve also having an annular ledge facing downwardly to bear and seal against the top of the filler neck, the sleeve having attaching means to anchor the sleeve to the filler neck, a single rigid depending tube located centrally of and within the annular sleeve and having a size significantly less than the inner diameter of the sleeve to permit free downward flow of liquid all around the inner periphery of the sleeve, the tube having a lower end free of the sleeve and extending downwardly beyond the lower end of the sleeve to extend into the filler neck, the tube having an upper end above the annular ledge and sleeve and being formed integrally of the receptacle wall, the upper end of the tube extending horizontally and outwardly through the receptacle wall and having a terminal end at the exterior of the receptacle wall, the horizontal upper end of the tube partially obstructing flow through the sleeve, an elongate flexible tubing connected with the terminal end of the rigid tube at the exterior of the receptacle to alternately extend upwardly along the receptacle and downwardly along the annular sleeve, a metal screen traversing the interior of the receptacle and above the upper end of the tube and indicating the level of the liquid in the receptacle to produce siphoning flow of liquid from the filler neck of the tank, and releasable retainer means on the receptacle wall at the exterior thereof and releasably holding the flexible tubing of the upper end thereof.

2. The funnel of claim 1 wherein the attaching means comprises threads on the sleeve.

3. The funnel of claim 1 wherein the attaching means comprises ears to be turned under a rim of the filler neck.

4. The funnel of claim 1 wherein the retainer means comprises an apertured ear formed integrally with the receptacle wall at the exterior thereof and adjacent the upper portion thereof.

* * * * *